US007135093B2

(12) United States Patent
Gstrein

(10) Patent No.: US 7,135,093 B2
(45) Date of Patent: Nov. 14, 2006

(54) PIN SEAMED PAPERMAKER'S PRESS FELT WITH CROSS MACHINE DIRECTION YARNS WOVEN IN DREHER WEAVE AT SEAM LOOPS

(75) Inventor: Hippolit Gstrein, Gloggnitz (AT)

(73) Assignee: Weavexx Corporation, Wake Forest, NC (US)

( * ) Notice: Subject to any disclaimer, the term of this patent is extended or adjusted under 35 U.S.C. 154(b) by 602 days.

(21) Appl. No.: 10/393,085

(22) Filed: Mar. 20, 2003

(65) Prior Publication Data

US 2004/0182467 A1 Sep. 23, 2004

(51) Int. Cl.
*D21F 7/08* (2006.01)
*D21F 7/12* (2006.01)
*D03D 3/04* (2006.01)

(52) U.S. Cl. ..... 162/358.2; 162/900; 162/902; 139/383 AA

(58) Field of Classification Search ..... 162/116, 162/117, 203–207, 348, 358.2, 361, 362, 162/900, 902, 903, 904; 442/270; 28/110, 28/142; 35/95, 116, 123; 139/383 A, 425 A, 139/383 AA
See application file for complete search history.

(56) References Cited

U.S. PATENT DOCUMENTS 5,411,062 A 5/1995 Lee ..... 139/383
5,476,123 A * 12/1995 Rydin ..... 139/383 AA
5,601,120 A 2/1997 Kuckart et al. ..... 139/383
5,787,936 A 8/1998 Snipes ..... 139/383
5,799,709 A 9/1998 Shipley ..... 139/383
5,913,339 A 6/1999 Lee ..... 139/383
6,000,441 A 12/1999 Lee et al. ..... 139/383
6,267,068 B1 * 7/2001 Fickers et al. ..... 112/440
6,267,150 B1 * 7/2001 Herring ..... 139/383 AA
6,378,566 B1 * 4/2002 Kornett ..... 139/383 AA
2002/0112274 A1 8/2002 Kornett

OTHER PUBLICATIONS

European Search Report for application No. EP 04005126 completed on Jun. 20, 2005.

* cited by examiner

*Primary Examiner*—Eric Hug
(74) *Attorney, Agent, or Firm*—Myers Bigel Sibley & Sajovec

(57) ABSTRACT

A press felt for a papermaking machine includes: a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions; and a first Dreher CMD yarn interwoven with a CMD yarn of the regular weave pattern located nearest to the seam loops and with the upper portions of the seam loops of at least one end of the press felt in a Dreher weave.

16 Claims, 11 Drawing Sheets

PIN SEAMED PAPERMAKER'S PRESS FELT WITH CROSS MACHINE DIRECTION YARNS WOVEN IN DREHER WEAVE AT SEAM LOOPS

FIELD OF THE INVENTION

The present invention relates generally to papermaking, and more particularly to fabrics used in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Press felts typically include one or more base fabric layers; these can be "flat-woven" and formed after weaving into an endless belt, or can be woven in endless form. Generally, the flat-woven process is preferred, as it is typically less expensive and more versatile than the endless weaving process. Also, in many instances the felt is cut widthwise and reattached to simplify installation on a paper machine, in which case some of the advantages of endless weaving (such as the absence of a seam in the fabric) are lost.

Of course, flat weaving a fabric of a base layer requires that provision be made for joining it into endless belts. Such joints should be constructed in such a manner that they are sufficiently strong to withstand the extreme load, temperature, and wear conditions the press felt experiences, yet do not cause the surface of the press felt above the seam to unduly mark the paper. One popular method of joining the base fabric of a press felt is to form loops with machine direction yarns on each end of the base fabric. To form the flat-woven base fabric into an endless belt, the ends of the fabric are placed adjacent to each other, with each of the loops on one end positioned between two loops on the other end in interdigitating fashion. A "pin" (usually formed of a single monofilament or monofilament strands) is then inserted into all of the loops to join the ends. After the batt layer(s) are needled or otherwise attached to the base layer, the batt layer(s) are cut at the seam location, the pin is removed, and the finished press felt is shipped to a paper mill. Once at the paper mill, the press felt can be installed by placing it onto a paper machine, then inserting another (usually more flexible) monofilament pin or pintle into the loops. Examples of this type of seam are described in U.S. Pat. Nos. 4,764,417 and 4,737,241 to Gulya; U.S. Pat. No. 4,601,785 to Lilja et al., and U.S. Pat. No. 5,476,123 to Rydin, the disclosures of which are hereby incorporated herein by reference in their entireties.

Not unexpectedly, the presence of a pin seam can create heterogeneity in the press felt in the pin seam area. For example, the compressibility and water and air permeability may be different at the seam area compared to the remainder of the press felt. Further, because the density of base fabric yarns is lower in the seam area, the batt fibers tend to be anchored less effectively in the seam. One approach to address some of these problems is to weave one or more additional yarns into the pin seam area that increase the yarn density on the paper side of the fabric. Examples of this approach are disclosed in the aforementioned U.S. Pat. No. 5,476,123 to Rydin and in U.S. Pat. No. 5,913,339 to Lee and U.S. Pat. No. 5,799,709 to Shipley.

SUMMARY OF THE INVENTION

The present invention is directed to pin-seamed press felts with additional CMD yarns located in the pin seam loops. As a first aspect, the invention is directed to a press felt for a papermaking machine, comprising: a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions; and a first Dreher CMD yarn interwoven with a CMD yarn of the regular weave pattern located nearest to the seam loops and with the upper portions of the seam loops of at least one end of the press felt in a Dreher weave. In this configuration, the press felt can have added yarn density at the seam to improve the uniformity of the press felt at the seam. Also, the use of the Dreher yarn can precisely fix the position of the last CMD yarn of the regular weave.

As a second aspect, the invention is directed to a press felt for a papermaking machine, comprising: a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions; an additional CMD yarn that passes between the upper and lower portions of each of the seam loops; and a first Dreher CMD yarn interwoven with the additional CMD yarn and with the upper portions of the seam loops of at least one end of the press felt in a Dreher weave. This configuration can provide the same types of benefits as are mentioned above.

DETAILED DESCRIPTION OF EMBODIMENTS OF THE PRESENT INVENTION

Figure 1:
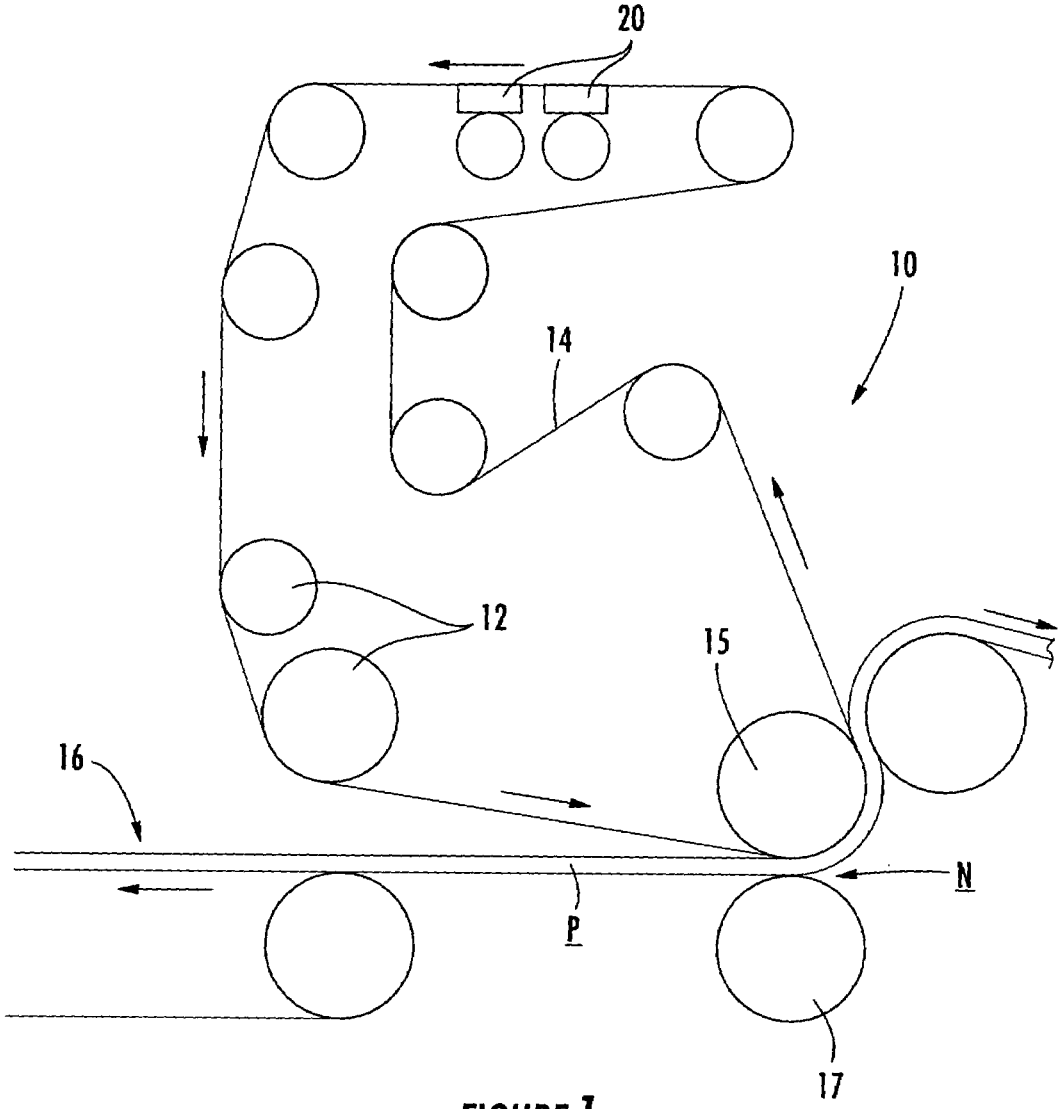
FIG. 1 is a schematic diagram illustrating the press section of a papermaking machine that may employ a press felt according to embodiments of the present invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both the flat weaving and endless weaving methods described hereinabove are well known in the art, and the term "endless belt" as used herein refers to belts made by either method.

Referring now to the drawings, a papermaking machine press section, designated broadly at 10, is illustrated in FIG. 1. The press section 10 includes a press felt 14 that is installed upon and conveyed by a set of rollers 12. In its travel, the felt 14 travels over a press roll 15. An opposed press roll 17 is positioned so that, in conjunction with the felt 14 and press roll 15, it forms a nip N between the press rolls 15.

In operation, a paper web P is conveyed from a forming section 16 through the nip N formed by the press rollers 15, 17, wherein pressure is applied to the paper web P by the press rolls 15, 17. The pressure forces moisture from the paper web P that is absorbed by the felt 14. As the felt 14 is conveyed around its roller set 12, moisture is removed therefrom, and the felt 14 is conditioned by one or more suction boxes 20.

Figure 2:
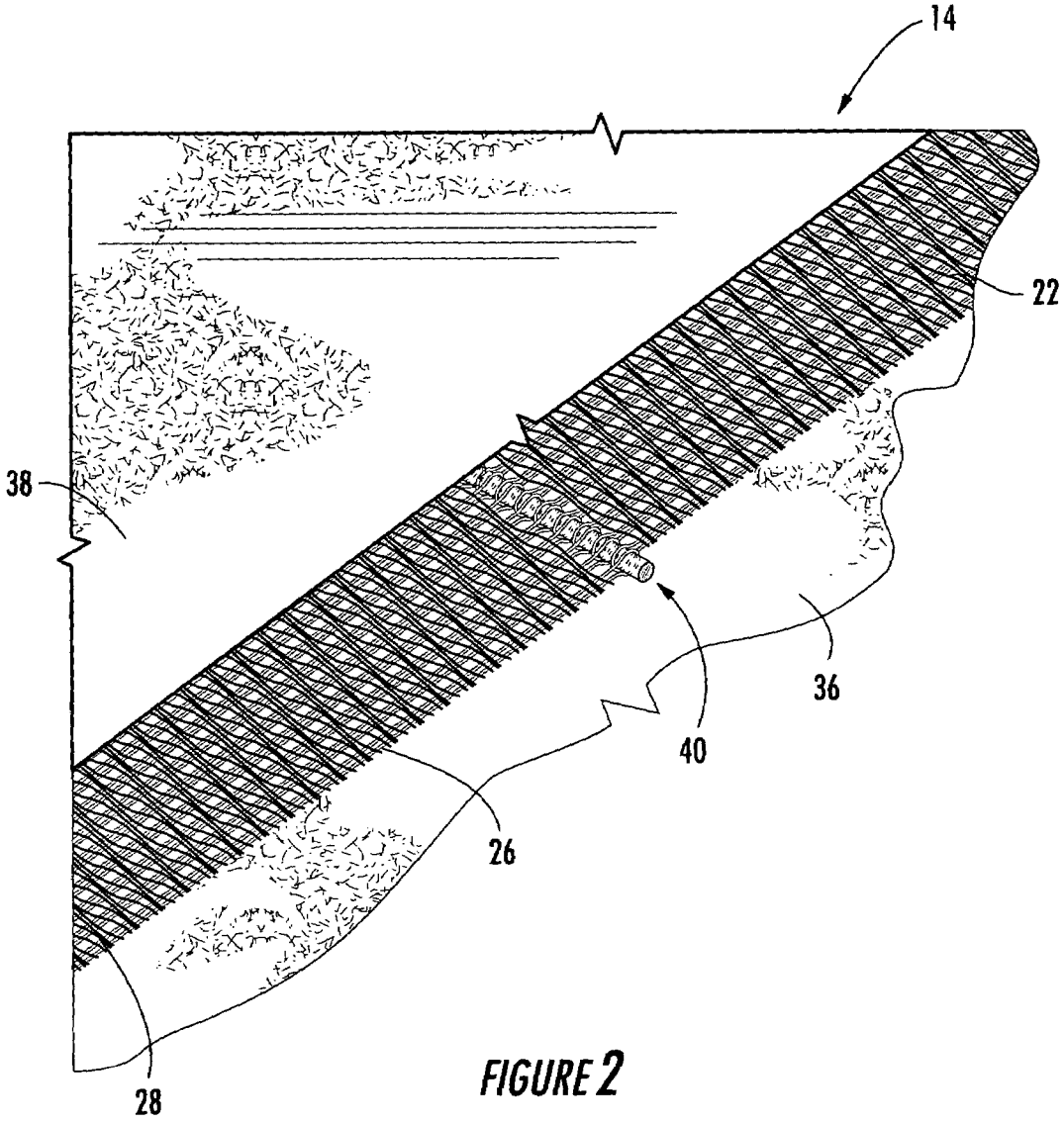
FIG. 2 is an enlarged, partial, cutaway perspective view of the press felt of FIG. 1 showing the pin seam of the press felt of FIG. 1.
Figure 3A:
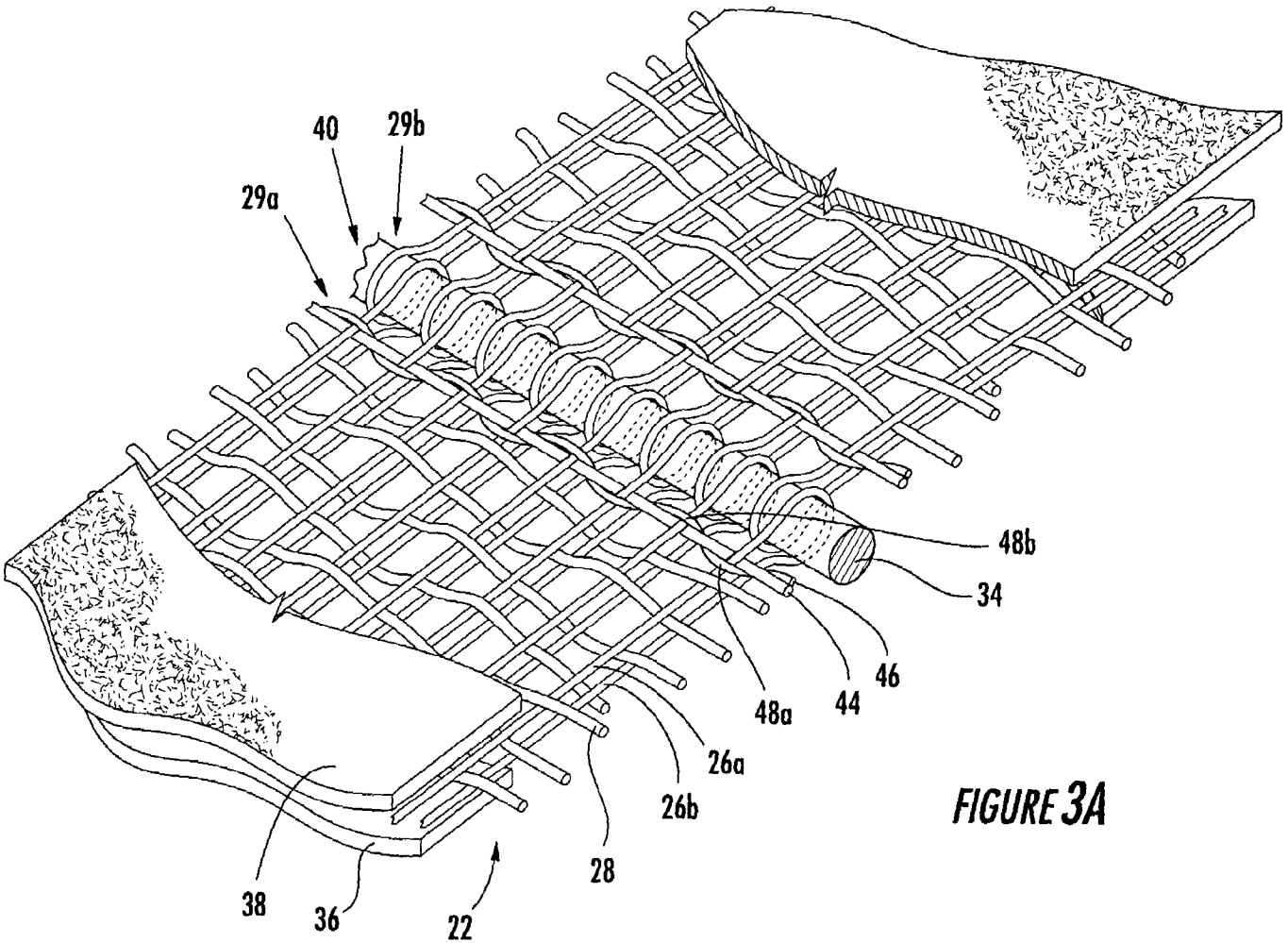
FIGS. 3A and 3B are greatly enlarged, partial perspective views of the pin seam of FIG. 2, with FIG. 3A showing the pin seam assembled and FIG. 3B showing the pin seam unassembled.
Figure 3B:
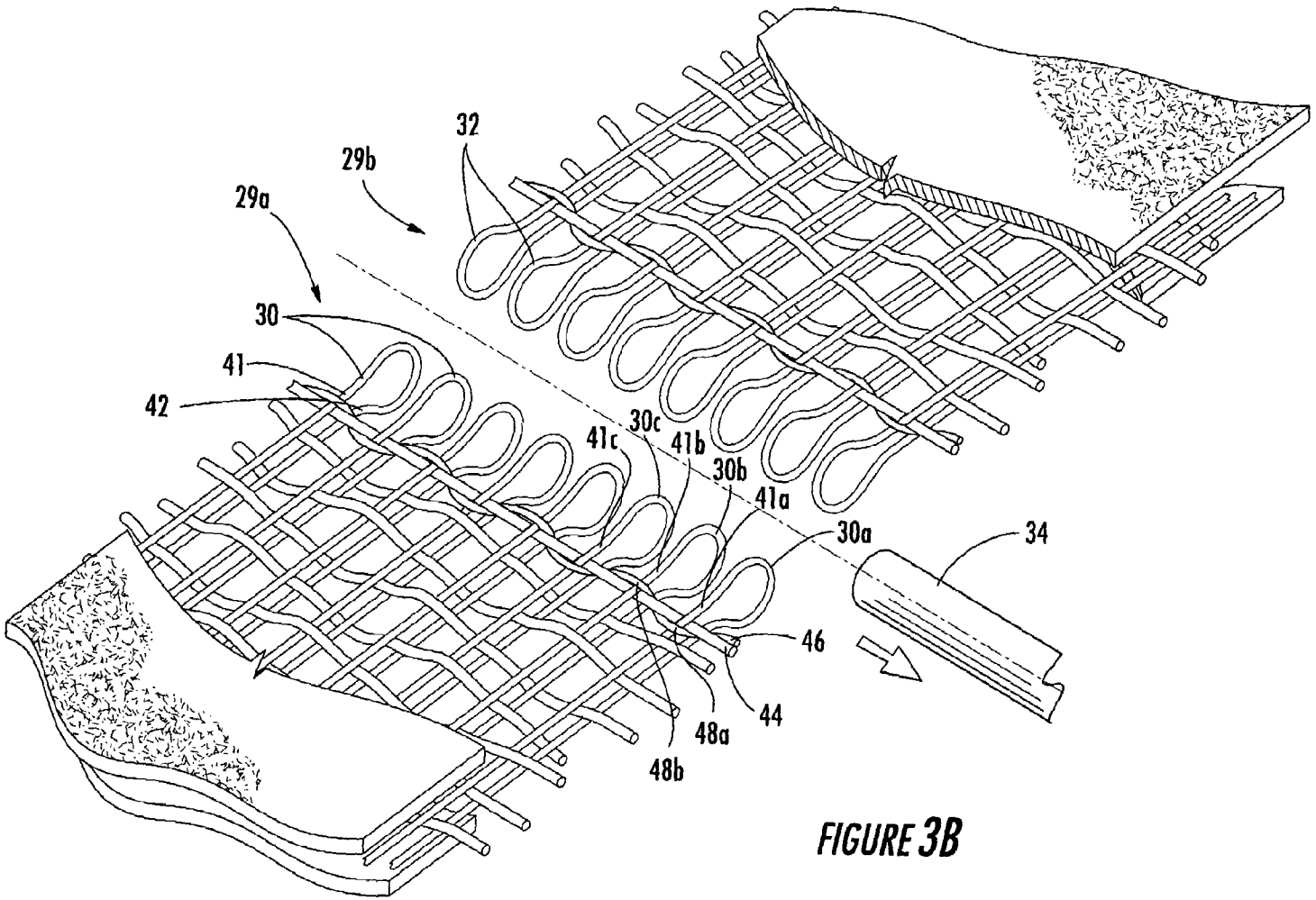

FIGS. 2, 3A and 3B illustrate enlarged sections of the felt 14. As can be seen in the aforementioned figures, the felt 14 includes a base fabric layer 22 which includes a set of machine direction yarns 26 (divisible into upper MD yarns 26*a* and lower MD yarns 26*b*) and a set of cross machine direction yarns 28 interwoven in a regular pattern with the machine direction yarns 26. The CMD yarns 28 are interwoven with the MD yarns 26 such that each CMD yarn 28 passes, sequentially, over one upper MD yarn 26*a*, between the next pair of upper and lower MD yarns 26*a*, 26*b*, below the next lower MD yarn 26*b*, and between the next pair of upper and lower MD yarns 26*a*, 26*b*. Adjacent CMD yarns 28 are offset from one another by one or more MD yarns 26 yarns to form, in the illustrated embodiment, a 1×4 satin pattern on the top surface of the base fabric 22.

The base fabric 22 is woven in a flat weave process; thus, in a flat condition, the fabric 22 has two free ends 29*a*, 29*b*, one of which (29*a*) includes seam loops 30 (formed by MD yarns 26), and the other of which (29*b*) includes seam loops 32 formed by the other ends of the MD yarns 26. When the base fabric 22 is in an endless condition such as that illustrated in FIGS. 2 and 3A, the loops 30, 32 are positioned in interdigitated fashion, and a pin 34 is inserted through the loops 30, 32 to join the ends 29*a*, 29*b* of the base fabric 22 to form a seam 40. It can be seen that the seam loops 30 include upper portions 41 and lower portions 42.

Those skilled in this art will recognize that other types of fabrics can be employed as the lower fabric layer of the base fabric layer 22 of the press felt 14, including other single layer fabrics, duplex fabrics (those having two sets of MD yarns and one set of CMD yarns), and triplex fabrics (i.e., those having two sets of machine direction yarns and two sets of cross machine direction yarns). Virtually any weave pattern known to those skilled in this art, such as the illustrated plain weave, twills, satins, and the like, can be used for this fabric layer.

Referring now to FIGS. 3A and 3B, at the seam 40, the upper portions 41 of the seam loops 30 are interwoven with two additional yarns: an anchoring yarn 44 and a Dreher yarn 46. The anchoring yarn 44 passes between the upper portions 41 and the lower portions 42 of each of the seam loops 30. The Dreher yarn 46 interweaves with the anchoring yarn 44 and the upper portions 41 of the seam loops 30 in a Dreher weave, which is described in detail below.

A Dreher weave is one in which a first yarn weaves on both sides of a second yarn that extends in nominally the same direction (i.e., both the first and second yarns are MD yarns or both are CMD yarns), wherein the first yarn passes below the second yarn and passes over and interlaces with multiple yarns that extend nominally in the opposite direction. Consequently, the second yarn of the Dreher weave passes above the first yarn and interlaces with the oppositely extending yarns by passing below them. The result is a somewhat serpentine path followed by at least one of the yarns. Additional information regarding Dreher weaves is set forth in, for example, Gewebetechnik, (VEB—Fachbuchverlag Leipzig, 1978).

A Dreher weave is demonstrated in the base fabric 22 shown in FIG. 3B by the interweaving of the Dreher yarn 46 and the anchoring yarn 44 with the upper portions 41 of the seam loops 30. As can be seen in FIG. 3B, the Dreher yarn 46 passes over the upper portion 41*a* of the seam loop 30*a* on the side of the anchoring yarn 44 away from the seam 40, under the anchoring yarn 44, above the upper portion 41*b* of the next seam loop 30*b* on the side of the anchoring yarn 44 adjacent the seam 40, under the anchoring yarn 44, over the upper portion 41*c* of the seam loop 30*c*, and so on in a repeating pattern. Thus, in the illustrated embodiment the Dreher yarn 46 forms single float knuckles 48*a*, 48*b* over each of the seam loop upper portions 41, wherein the knuckles are alternately positioned on opposite sides of the anchoring yarn 44 as the Dreher yarn 46 extends in the cross machine direction.

In this configuration, the anchoring yarn 44 is positioned to provide a yarn at the seam 40 that can help to increase the yarn density at the seam 40 and that can assist in anchoring batt fibers inserted in the seam area. Also, the Dreher yarn can assist in precisely fixing the position of the anchoring yarn 44 in the seam area.

Typically, the anchoring yarn 44 may be of any form (e.g., monofilament, multifilament, hybrid yarns, meltable monofilaments, and twists) known to be suitable for use in press felts, although monofilaments or twists are preferred. The anchoring yarn will typically have a diameter of between about 0.2 and 0.5 mm or, if in three ply twists, each monofilament will typically have a diameter of between about 0.1 and 0.3 mm each. The Dreher yarn may take any form (e.g., monofilament, multifilament, hybrid yarns, meltable monofilaments, and twists), with multifilaments being preferred. The Dreher yarn will typically have a fineness of between about 50 and 500 dtex. These descriptions of the Dreher yarn and the anchoring yarn are equally applicable to the press felt embodiments described below.

Figure 4:
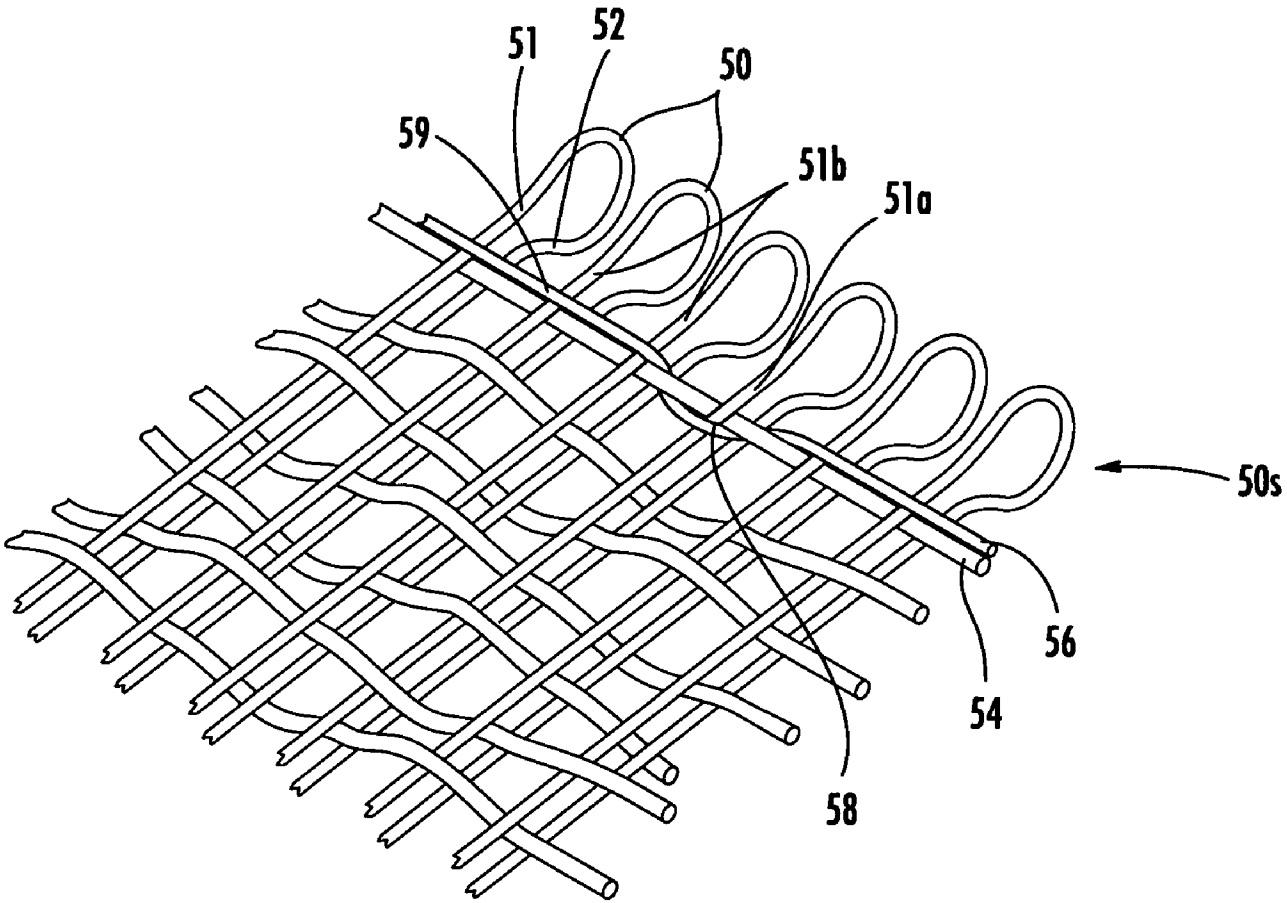
FIG. 4 is a greatly enlarged, partial perspective view of seam loops and additional yarns according to another embodiment of the present invention.

The concept of employing a Dreher weave at the seam loops can be extended to other configurations. For example, another embodiment of a press felt having seam loops 50 that form a seam 50*s* is illustrated in FIG. 4. In this embodiment, an anchoring yarn 44 passes between upper portions 51 and lower portions 52 of the seam loops 50 in the manner described with respect to the embodiment of FIGS. 3A and 3B. However, a Dreher yarn 56 is woven such that it forms single float knuckles 58 over the upper portions 51*a* on one side of the anchoring yarn 54 (the side away from the seam 50*s*) and three yarn floats 59 (i.e., the Dreher yarn 54 passes over the upper portions 51*b* of the seam loops 50 of three consecutive MD yarns) on the opposite side of the anchoring yarn 54. As with the embodiment of FIGS. 3A and 3B, the Dreher yarn 56 can help to precisely fix the position of the anchoring yarn 54, and the anchoring yarn 54 can increase the density at the seam and provide anchoring for batt fibers.

Figure 5:
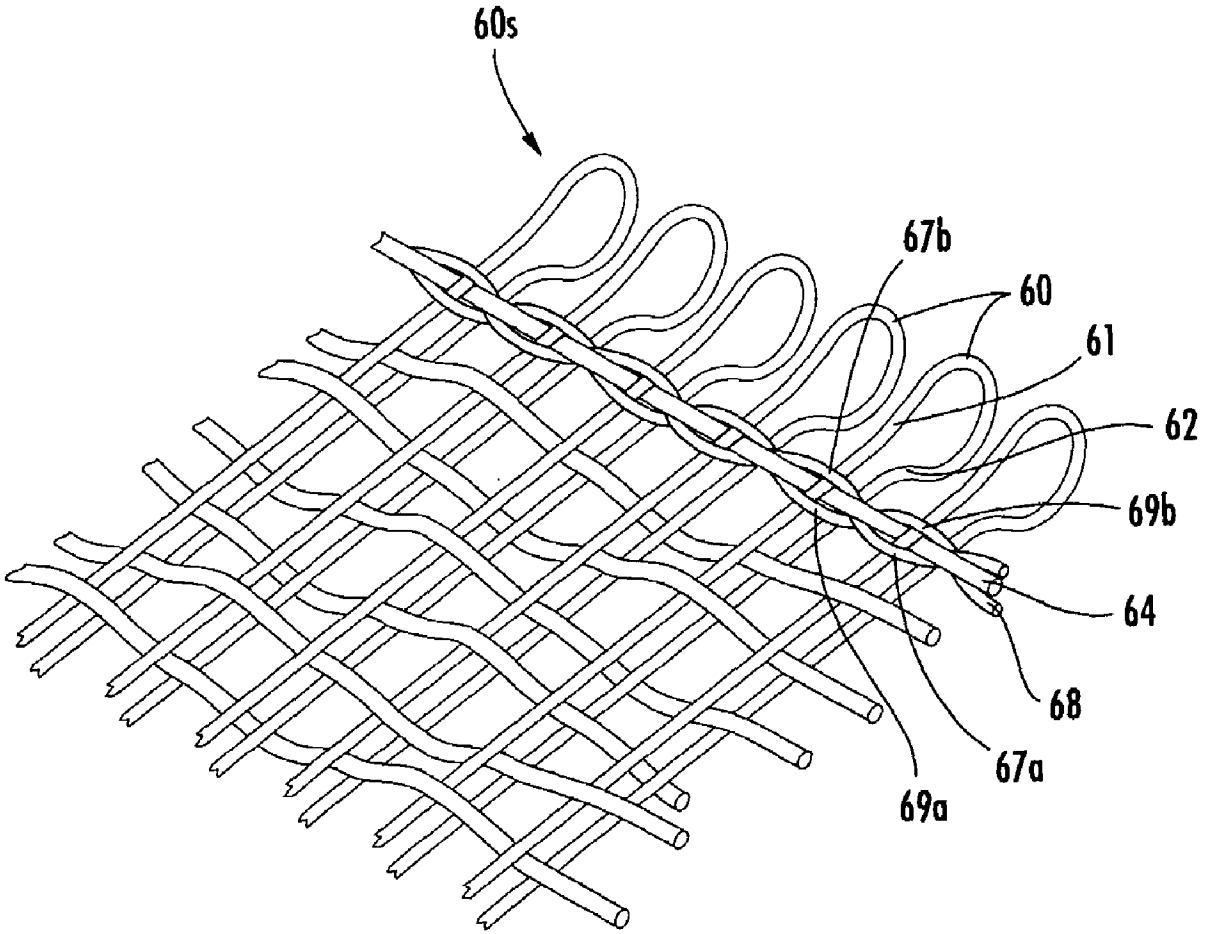
FIG. 5 is a greatly enlarged, partial perspective view of seam loops and additional yarns according of an additional embodiment of the present invention.

An additional embodiment of a press felt of the invention is illustrated in FIG. 5. The press felt illustrated therein includes seam loops 60 with upper portions 61 and lower portions 62 as well as an anchoring yarn 64 that passes between the upper and lower portions 61, 62 of the seam loops 60. One Dreher yarn 66 alternately forms knuckles 67*a*, 67*b* on opposite sides of the anchoring yarn 64 as it passes over the upper portions 61 of the seam loops 60. A second Dreher yarn 68 is woven such that it forms knuckles 69*a* over the upper portions 61 away from the seam 60*s* when the Dreher yarn 66 is forming knuckles 67*b* adjacent the seam 60*s*, and forms knuckles 69*b* over upper portions 61 of the seam loops 60 adjacent the seam 60*s* when the Dreher yarn 66 is forming knuckles 67*a* away from the seam 60*s* (i.e., the first and second Dreher yarns are woven in opposite Dreher patterns). The form, material and size of the second Dreher yarn may be the same as what is described above for the first Dreher yarn, or it may differ as warranted.

Figure 6:
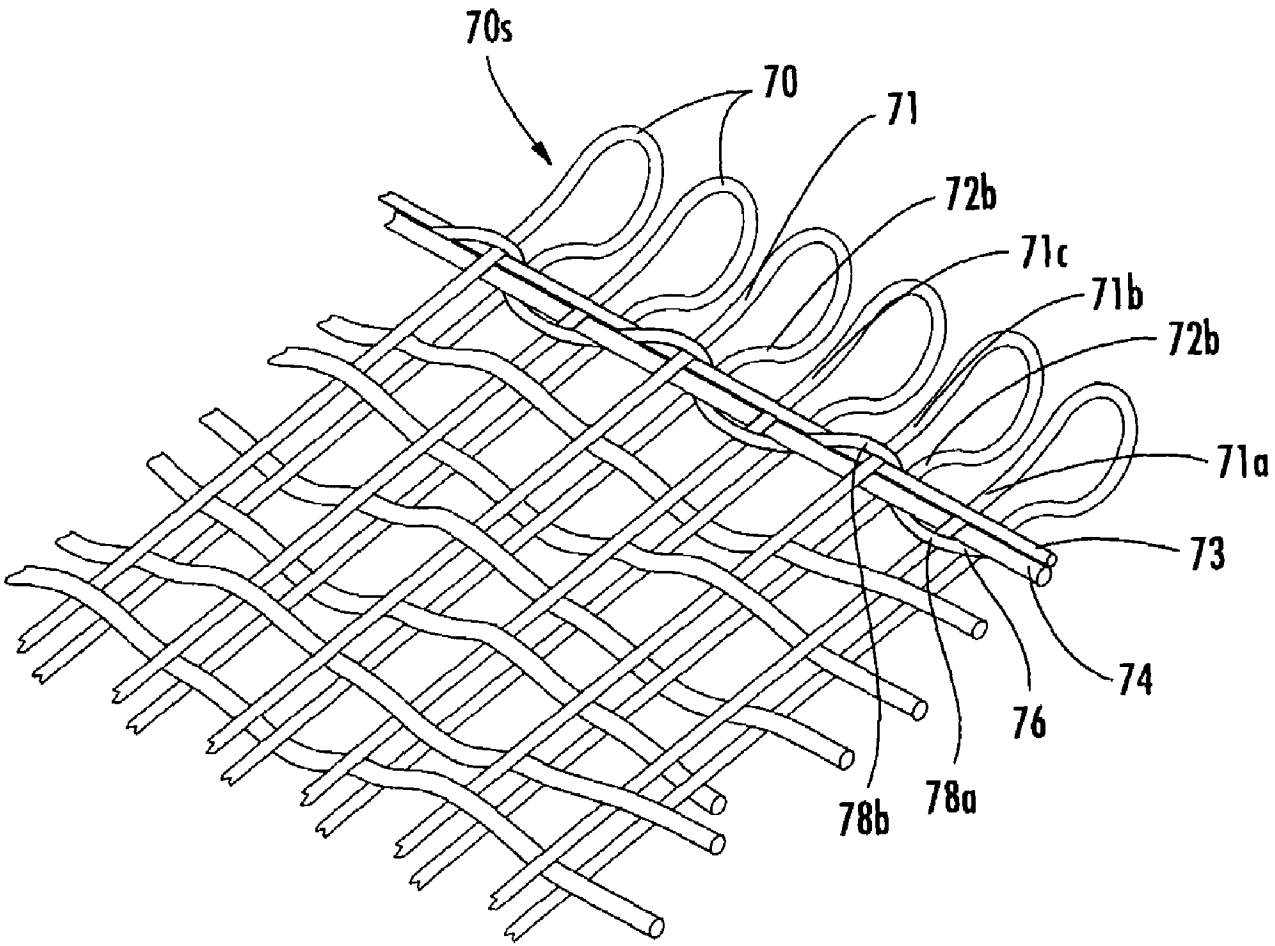
FIG. 6 is a greatly enlarged, partial perspective view of seam loops and additional yarns according to a further embodiment of the present invention.

A further embodiment of a press felt of the present invention is illustrated in FIG. 6. The press felt illustrated therein includes seam loops 70 having upper portions 71 and lower portions 72 and an anchoring yarn 74 that passes between the upper and lower portions 71, 72. An additional CMD yarn 73 is woven with the upper portions 71 of the seam loops 70 nearer to the seam 70*s* than the anchoring yarn 74. The additional CMD yarn 73 alternately passes over the upper portion 71*a* of one MD yarn, then between the upper and lower portions 71*b*, 72*b* of the next MD yarn 71, then above the upper portion 71*c* of the next MD yarn 71, and so on in a repeating pattern. A Dreher yarn 76 forms single float knuckles 78*a*, 78*b* over alternate seam loop upper portions 71 on opposite sides of both the additional CMD yarn 73 and the anchoring yarn 74 and passes below both the additional CMD yarn 73 and the anchoring yarn 74 as it extends between adjacent MD yarns to form the aforementioned knuckles 78*a*, 78*b*.

The additional CMD yarn 73 typically takes the form of a single ply or mutli-ply yarn, but may take any form. The diameter of the additional CMD yarn is typically between about 0.2 mm and 0.5 mm, or it may have a fineness of between about 50 and 500 dtex. This description is equally applicable to additional CMD yarns described below in other embodiments.

Figure 7:
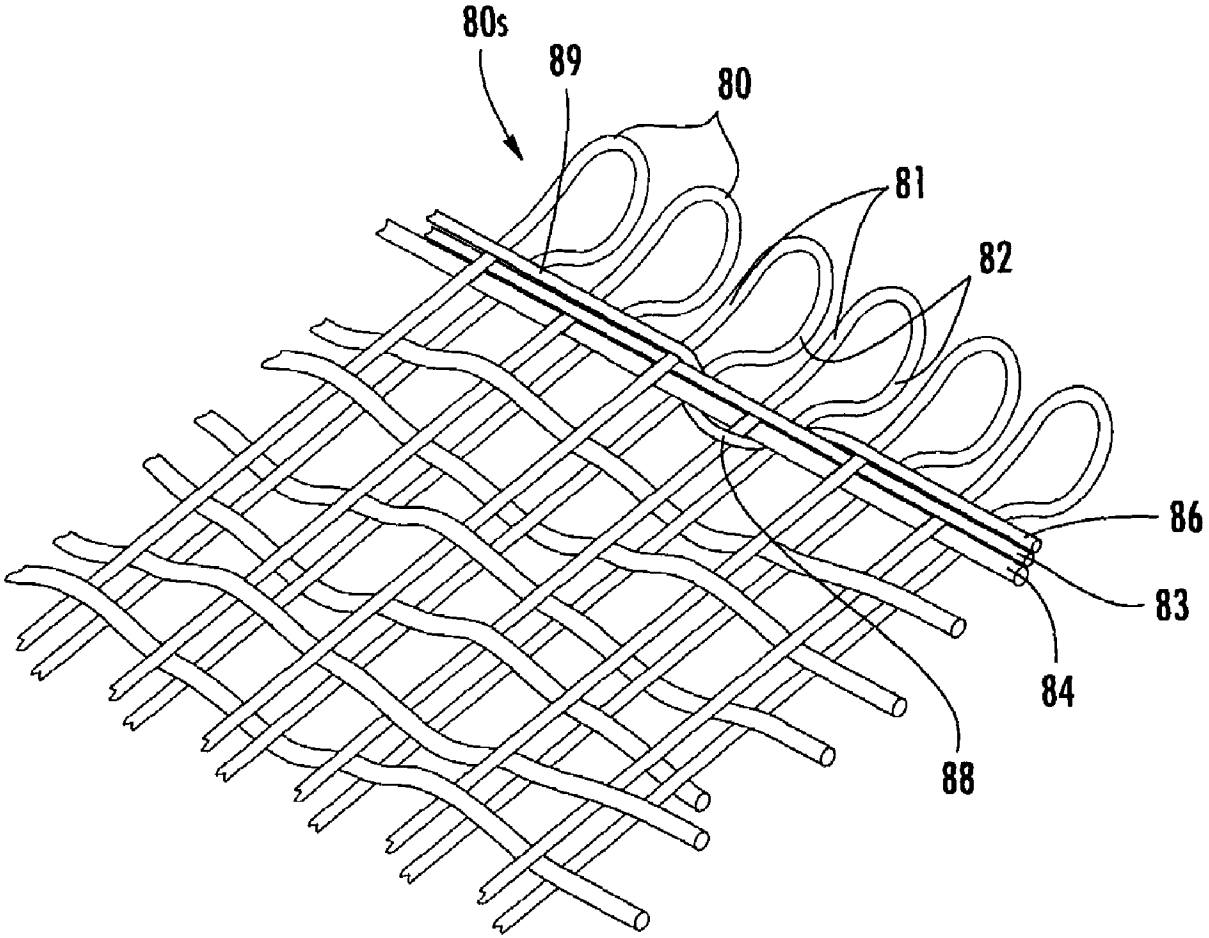
FIG. 7 is a greatly enlarged, partial perspective view of seam loops and additional yarns according to still another embodiment of the present invention.

Another embodiment of a press felt of the invention is illustrated in FIG. 7. The press felt shown in FIG. 7 includes seam loops 80 with upper and lower portions 81, 82, and includes an additional CMD yarn 83 and an anchoring yarn 84 like those described above in connection with the embodiment of FIG. 6. A Dreher yarn 86 forms, alternately, single float knuckles 88 on the side of the additional CMD yarn 83 and the anchoring yarn 84 away from the seam 80*s* and three-yarn floats 89 over the seam loop upper portions 81 near the seam 80*s*.

Figure 8:
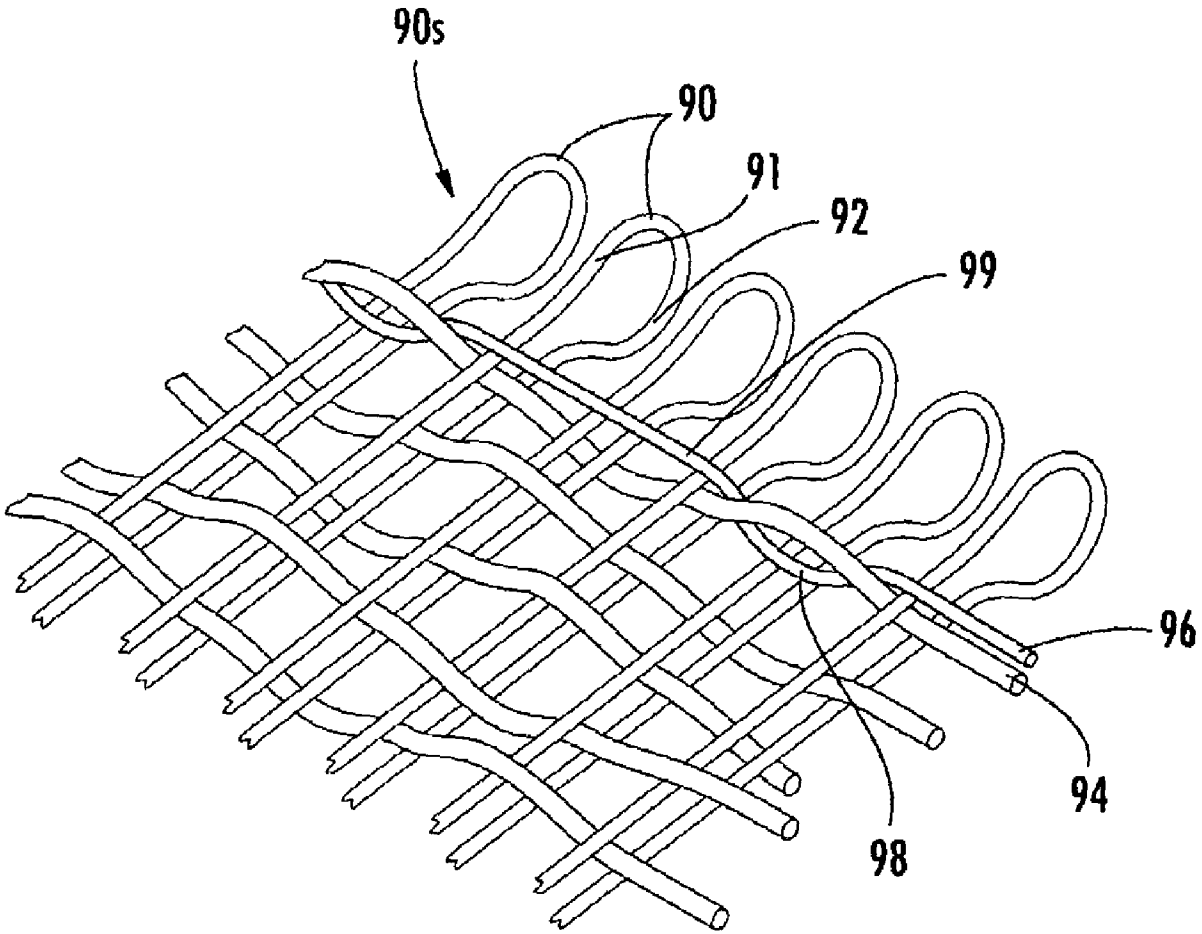
FIG. 8 is a greatly enlarged, partial perspective view of seam loops and additional yarns according to yet another embodiment of the present invention.

An additional embodiment of a press felt of the present invention is illustrated in FIG. 8. In this embodiment, the press felt includes seam loops 90 with upper and lower portions 91, 92. Rather than employing an anchoring yarn like those described above and illustrated in FIGS. 3A–7, in this embodiment a Dreher yarn 96 interweaves in a Dreher pattern with the CMD yarn 94 of the fabric that follows the regular weave pattern and that is nearest to the seam loops 90. The Dreher yarn 96 interweaves to form single float knuckles 98 on the side of the CMD yarn 94 away from the seam 90*s* and three-yarn floats 99 on the side of the CMD yarn 94 nearest the seam 90*s*.

Typically, the CMD yarn 94 nearest the seam 90*s* will take the same form, will be formed of the same material, and will have the same diameter as the other CMD yarns of the press felt. However, this need not be the case, and the CMD yarn 94 may take other forms known to those skilled in this art to be suitable for use in press felts. This description is equally applicable to the embodiments below in which the CMD yarn nearest the seam is interwoven with a Dreher yarn.

Figure 9:
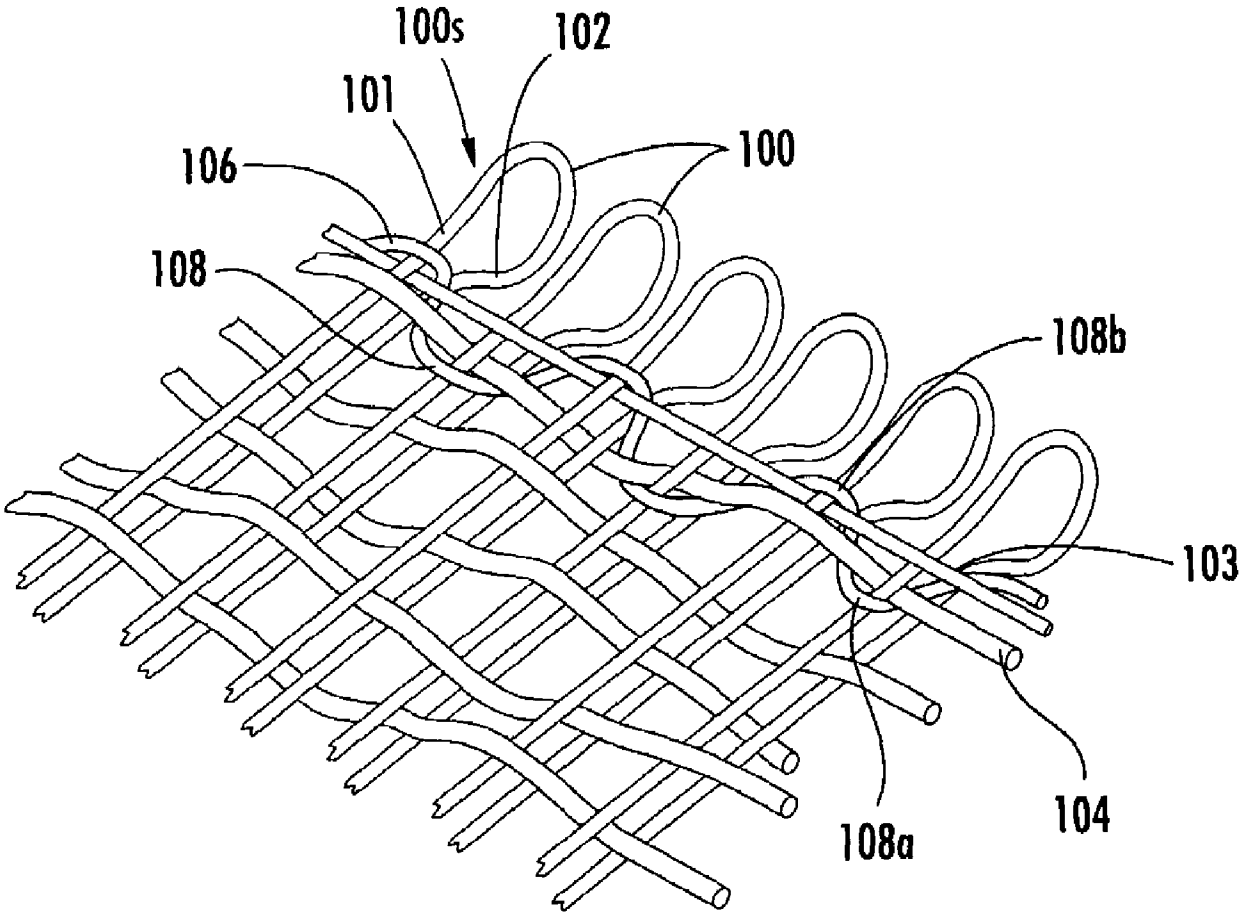
FIG. 9 is a greatly enlarged, partial perspective view of seam loops and additional yarns according to even another embodiment of the present invention.

Referring now to FIG. 9, another embodiment of a press felt of the present invention is illustrated therein. This embodiment includes seam loops 100 with upper portions 101 and lower portions 102. A CMD yarn 104 is the CMD yarn of the regular weave pattern that is positioned nearest to the seam 100*s*. An additional CMD yarn 103 interweaves in an "over/under/over/under" sequence with the seam loop upper portions 101. A Dreher yarn 106 passes below the CMD yarn 104 and the additional CMD yarn 103 as it interweaves to form knuckles 108*a*, 108*b* over alternate seam loop upper portions 101 of alternate MD yarns on opposite sides of the CMD yarn 104 and the additional yarn 103 in the manner described above for the embodiments of FIGS. 3A, 5 and 6.

Figure 10:
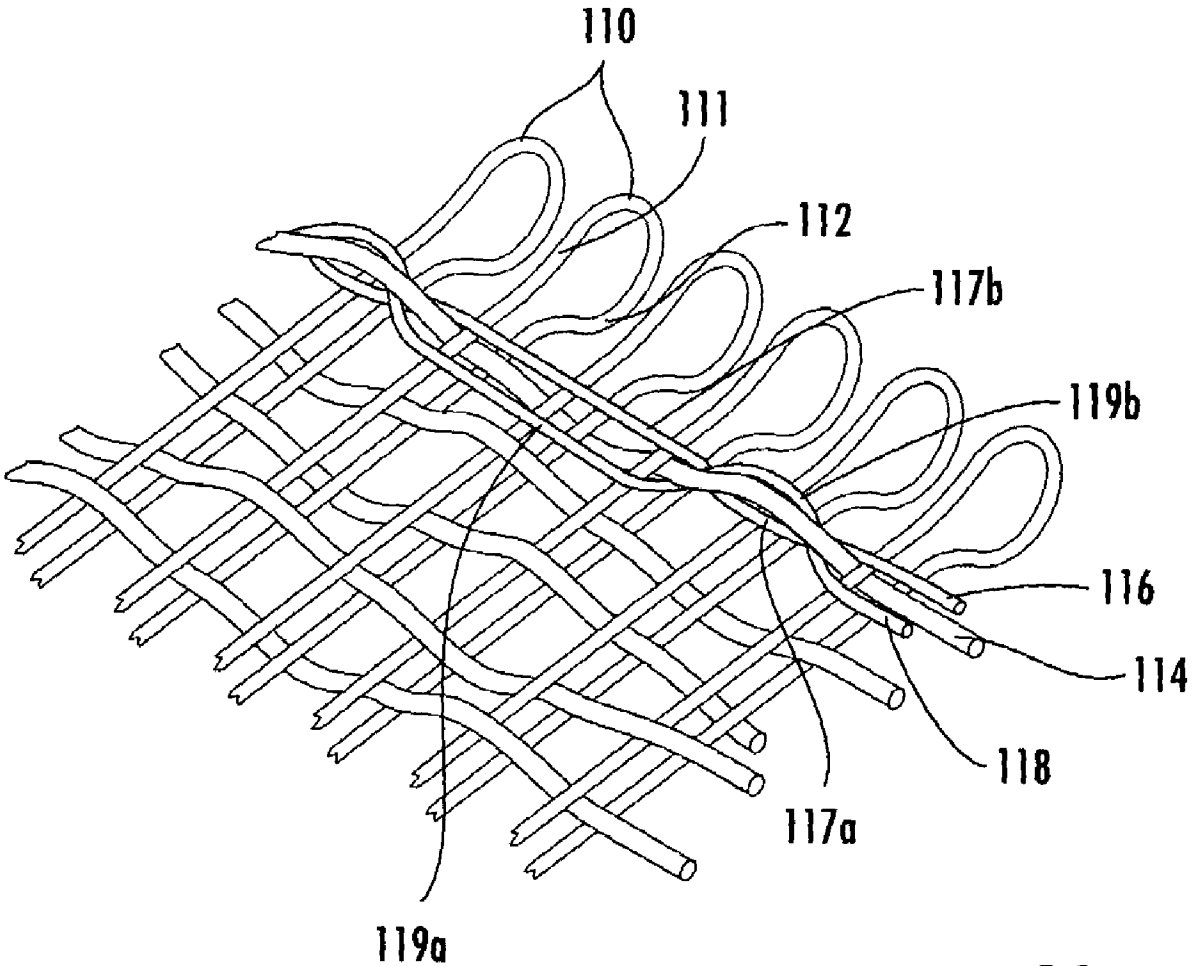
FIG. 10 is a greatly enlarged, partial perspective view of seam loops and additional yarns according to still another embodiment of the present invention.

Referring now to FIG. 10, a still further embodiment of a press felt of the invention is illustrated. This embodiment includes seam loops 110 with upper portions 111 and lower portions 112. A CMD yarn 114 is the CMD yarn of the regular weave pattern that is positioned nearest the seam. A Dreher yarn 116 is interwoven with the CMD yarn 114 in a Dreher weave to form knuckles 117*a* on the side of the CMD yarn away from the seam 110*s* and three-yarn floats 117*b* on the side of the CMD yarn nearest the seam 110*s*. A second Dreher yarn 118 is woven in a Dreher weave with the CMD yarn 114 oppositely from the Dreher yarn 116, such that it forms knuckles 119*b* on the side of the CMD yarn 114 nearest the seam 110*s* and three-float knuckles 119*a* on the side of the CMD yarn 114 away from the seam 110*s*.

Those skilled in this art will recognize that other combinations of Dreher weaves at the seam loop are also possible. For example, a press felt may include an anchoring yarn of the type shown in the embodiments of FIGS. 3A–7 in combination with the Dreher yarn patterns shown in FIG. 10. As another example, a press felt may include the nearest CMD yarn of the regular pattern shown in FIG. 10 with two Dreher yarns woven as shown in FIG. 5, such that each Dreher yarn forms knuckles on both sides of that CMD yarn. Other modifications which can provide similar benefits and performance advantages may be apparent to those skilled in this art and need not be described in detail herein.

For any of the illustrated or described embodiments, the press felt of the invention may also include one or more batt layers. Referring back to FIG. 2, the press felt 14 includes two batt layers: a machine side batt layer 120 and a paper side batt layer 122. Illustratively and preferably, these batt layers 120, 122 are attached to the base fabric layer 22 through a needling process, although other attachment techniques, such as heat bonding and adhesives, can also be used with the present invention. The machine side and paper side batt layers 120, 122 should be formed of material, such as a synthetic fiber like acrylic, aramid, polyester, or nylon, or a natural fiber such as wool, that assists in wicking water away from the base fabric layer 22. Preferred materials for the batt layers 120, 122 include polyamide, polyester and blends thereof. The weight and thickness of the batt layers 120, 122 can vary, although it is preferably that the ratio of batt weight to fabric weight is about between about 0.5 and 2.0, with 1.0 being more preferred. Also, in some embodiments, it may be desirable to have additional batt layers or to omit either or both of the batt layers 120, 122.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

The invention claimed is:

1. A press felt for a papermaking machine, comprising:

a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions;

a first Dreher CMD yarn interwoven with a CMD yarn of the regular weave pattern located nearest to the seam loops and with the upper portions of the seam loops of at least one end of the press felt in a Dreher weave; and a second Dreher CMD yarn woven with the upper portions of the seam loops in a Dreher weave that is opposite to the Dreher weave of the first Dreher CMD yarn.

2. The press felt defined in claim 1, wherein the first Dreher CMD yarn passes over each upper portion of each seam loop.

3. The press felt defined in claim 2, wherein the first Dreher CMD yarn forms a knuckle over each upper portion of each seam loop.

4. The press felt defined in claim 3, further comprising an additional CMD yarn that passes alternately above and below the upper portions of adjacent seam loops.

5. The press felt defined in claim 2, wherein the first Dreher CMD yarn alternately forms knuckles and floats over upper portions of adjacent seam loops.

6. The press felt defined in claim 4, wherein floats formed by the additional CMD yarn are floats formed over three adjacent yarns.

7. A press felt for a papermaking machine, comprising:

a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions;

an anchoring CMD yarn that passes between the upper and lower portions of each of the seam loops; and a first Dreher CMD yarn interwoven with the additional CMD yarn and with the upper portions of the seam loops of at least one end of the press felt in a Dreher weave.

8. The press felt defined in claim 7, wherein the first Dreher CMD yarn passes over each upper portion of each seam loop.

9. The press felt defined in claim 8, wherein the first Dreher CMD yarn forms a knuckle over each upper portion of each seam loop.

10. The press felt defined in claim 8, wherein the first Dreher CMD yarn alternately forms knuckles and floats over upper portions of adjacent seam loops.

11. The press felt defined in claim 8, further comprising an additional CMD yarn that passes alternately above and below the upper portions of adjacent seam loops.

12. The press felt defined in claim 9, further comprising an additional CMD yarn that passes alternately above and below the upper portions of adjacent seam loops.

13. The press felt defined in claim 9, further comprising a second Dreher CMD yarn woven with the upper portions of the seam loops in a Dreher weave that is opposite to the Dreher weave of the first Dreher CMD yarn.

14. The press felt defined in claim 10, further comprising a second Dreher CMD yarn woven with the upper portions of the seam loops in a Dreher weave that is opposite to the Dreher weave of the first Dreher CMD yarn.

15. A press felt for a papermaking machine, comprising:

a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions;

a first Dreher CMD yarn interwoven with a CMD yarn of the regular weave pattern located nearest to the seam loops and with the upper portions of the seam loops of at least one end of the press felt in a Dreher weave; and an additional CMD yarn that passes alternately above and below the upper portions of adjacent seam loops;

wherein the first Dreher CMD yarn forms a knuckle over each upper portion of each seam loop.

16. A press felt for a papermaking machine, comprising:

a base fabric comprising a plurality of machine direction (MD) yarns interwoven with a plurality of cross machine direction (CMD) yarns in a predetermined regular weave pattern, the MD yarns being divisible into upper MD yarns, lower MD yarns, and seam loops merging with either end of the upper and lower MD yarns, the seam loops defining the longitudinal ends of the press felt and having upper and lower portions;

a first Dreher CMD yarn interwoven with a CMD yarn of the regular weave pattern located nearest to the seam loops and with the upper portions of the seam loops of at least one end of the press felt in a Dreher weave; and an additional CMD yarn that passes alternately above and below the upper portions of adjacent seam loops;

wherein the first Dreher CMD yarn alternately forms knuckles and floats over upper portions of adjacent seam loops.

* * * * *